US007331481B2

(12) United States Patent
van Eijndhoven et al.

(10) Patent No.: US 7,331,481 B2
(45) Date of Patent: Feb. 19, 2008

(54) GAS-TIGHT OR PARTLY GAS-PERMEABLE TRANSPORT PACKAGE, AND METHOD AND APPARATUS FOR MANUFACTURING SAME

(75) Inventors: Peter Paul van Eijndhoven, Barneveld (NL); Richard Vos, Hoogeveen (NL)

(73) Assignee: Kappa "GSF" B.V., Oude Pekela (NL)

( * ) Notice: Subject to any disclaimer, the term of this patent is extended or adjusted under 35 U.S.C. 154(b) by 307 days.

(21) Appl. No.: 10/363,336

(22) PCT Filed: Sep. 3, 2001

(86) PCT No.: PCT/NL01/00650

§ 371 (c)(1),
(2), (4) Date: Jun. 20, 2003

(87) PCT Pub. No.: WO02/20359

PCT Pub. Date: Mar. 14, 2002

(65) Prior Publication Data

US 2004/0094611 A1 May 20, 2004

(30) Foreign Application Priority Data

Sep. 4, 2000 (NL) ..... 1016099

(51) Int. Cl.

| | |
|---|---|
| ***B65D 25/14*** | (2006.01) |
| ***B65D 35/14*** | (2006.01) |
| ***B65D 90/00*** | (2006.01) |
| ***B65D 5/56*** | (2006.01) |

(52) U.S. Cl. ..... 220/495.01; 229/125.35

(58) Field of Classification Search ..... 220/23.86, 220/23.9, 62.13, 495.01, 495.03, 495.11; 229/5.84, 117.7, 117.27, 122.32, 122.33, 229/125.35, 164.2, 167

See application file for complete search history.

(56) References Cited

U.S. PATENT DOCUMENTS

| | | | | |
|---|---|---|---|---|
| 1,576,088 | A * | 3/1926 | Bunz | 220/575 |
| 2,019,870 | A * | 11/1935 | Perry | 229/114 |
| 3,195,425 | A | 7/1965 | Taggart | |
| 3,863,830 | A | 2/1975 | Christensson | |
| 4,555,381 | A * | 11/1985 | Chazal et al. | 264/516 |
| 4,779,758 | A * | 10/1988 | Chazal et al. | 229/5.84 |
| 5,028,000 | A * | 7/1991 | Chabot et al. | 229/143 |
| 6,112,890 | A * | 9/2000 | Colombo | 206/213.1 |

FOREIGN PATENT DOCUMENTS

| | | | |
|---|---|---|---|
| EP | 0 192 537 | A | 8/1986 |
| EP | 0 731 032 | A | 9/1996 |
| EP | 731032 | A1 * | 9/1996 |
| WO | WO79 00171 | A | 4/1979 |

* cited by examiner

*Primary Examiner*—Anthony D. Stashick
*Assistant Examiner*—Harry A Grosso
(74) *Attorney, Agent, or Firm*—Weingarten, Schurgin, Gagnebin & Lebovici LLP

(57) ABSTRACT

A package, comprising an outer package formed from relatively rigid material and an inner package formed from at least two layers of film material, the two layers of film material being gas-tightly connected to each other near their circumference by means of an inherently closed sealing edge, which is formed against a wall part of the outer package.

16 Claims, 4 Drawing Sheets

GAS-TIGHT OR PARTLY GAS-PERMEABLE TRANSPORT PACKAGE, AND METHOD AND APPARATUS FOR MANUFACTURING SAME

The invention relates to a package. More in particular, the invention relates to a gas-tight or partly gas-permeable package for transporting goods, in particular comestibles.

From practice, it is known to package comestibles in separate, gas-tight consumer portions. These so-called Modified Atmosphere (MA) packages usually comprise a plastic saucer for supporting the product and a film stretched around the saucer with the product and whose edges are sealed onto each other in a gas-tight manner. In such a gas-tight package, an environment can be created which is favorable to the product, for instance by replacing the air in the package wholly or partially by a mixture of other gases, such as nitrogen or carbon dioxide. Thus, for instance, the shelf life or the freshness of the product can be increased. Moreover, the package is odor-tight, so that the packaged product is protected from exterior odor influences and, conversely, the product cannot affect the odor and taste of neighboring goods. Hence, such an MA-package is eminently suitable for packaging odor-sensitive products or products which give off a strong odor themselves, such as meat or fish.

In FR 2,576,874 it has been proposed to manufacture an MA-transport package by lining a cardboard box with a film of a thermoplastic material, which film reaches beyond the upper edge of the box. After the box has been filled, a second film is stretched over its upper side and subsequently, outside the box, thermally sealed onto the first film, while using an anvil as sealing base. The package thus obtained is gas-tight and odor-tight and, moreover, has sufficient bearing strength for transporting larger amounts of goods. However, this known package has as a drawback that the edges along which the two films have been sealed together extend beyond the outer surface of the box. Consequently, the packages cannot be positioned directly next to each other nor can they be stacked in a stable manner. The fact is that when stacking, the edges will be in each other's way and will partly overlap the surrounding boxes. Moreover, such edges can complicate removing a package positioned in a stack, as the edges can get caught behind or between surrounding packages thus, possibly, causing damage to the package. It is also possible that, by pulling away an edge lodged in such a manner, a package placed on this edge is brought into motion and falls over.

The invention contemplates a transport package, wherein the above-mentioned drawbacks have been eliminated while maintaining its advantages. To that end, a package according to the invention is characterized by the features of claim 1.

As the two layers of film material which together form the inner package are attached onto each other against a wall part of the outer package, for instance the upper edge, the package is clear of projecting edges. Such packages can be placed on top of and next to each other in a stable and compact manner. The relatively rigid outer package protects the inner package and provides for sufficient bearing capacity and stacking strength. The inner package seals off the products in a gas-tight and odor-tight manner, so that, for instance, different goods can be transported in one transport unit, for instance a cold storage container, without them influencing each other's taste and/or odor. Moreover, with such a package, the shelf life can be prolonged. After use, the package can simply be separated into an inner and outer package. Depending on the material from which it has been manufactured, the outer package can either be cleaned and reused, or be recycled, and so can the inner package.

In an advantageous embodiment, a package according to the invention is characterized by the features of claim 5.

By using at least for the second, covering film layer of the inner package a film permeable in at least one direction, at least a one-sided exchange of gases between the inner package and the surroundings can be brought about. This can for instance be favorable with "living" products, such as vegetables and fruit, which products, during their residence in the package, convert oxygen into $CO_2$. As a result, the content of $CO_2$ within the package increases. By presently using a semi-permeable film, at least a part of the $CO_2$ produced in the package can be emitted to the environment, so that the content within the package does not become too high and the products are not suffocated. Tests have shown that with such a permeable film live products can be packaged so that they remain fresh and can be preserved for a long time, even when the inner package is initially filled with ordinary air instead of, for instance, an active gas.

Besides a semi-permeable film, a two-way permeable film can be used, so that not only gases can be discharged from the inner package into the environment, but also gases from that environment can penetrate into the package. Wholly or partially permeable films can be manufactured from a material suitable to that end and known per se, such as, for instance, Goretex. Also, a permeable film can be created by providing an inherently non-permeable material with micro-perforations.

In a further elaboration, a package according to the invention is characterized by the features of claim 6.

In case the outer package is manufactured from a heat sensitive material, such as for instance polystyrene foam or a thermoplastic plastic, it can be easily prevented that the outer layer becomes damaged during the sealing together of the layers of film material by applying a heat resistant layer to the part of the outer package against which the sealing edge is applied. Thus, for instance, if the sealing edge is applied to the upper edge of the outer package, this upper edge can be provided with a separate cardboard edge which can be glued onto the outer package.

In an advantageous embodiment, a package according to the invention is characterized by the features of claim 7.

An outer package of cardboard can be manufactured in a simple and relatively low-cost manner, while, still, a particularly rigid package can be realized. Moreover, cardboard is relatively well resistant to heat, so that the upper edge does not require any special adaptation. Furthermore, cardboard is recyclable and can be included in already existing recycling flows.

In further elaboration, a package according to the invention is characterized by the features of claim 9.

By reinforcing the outer package, in particular its sidewalls, the stacking strength and the bearing capacity of the package increase. As a result, also, the upper edge is better supported, so that it is even better resistant to the pressure exerted on it during closure of the inner package. The sidewalls can for instance be reinforced by manufacturing them from two or more layers of cardboard. An additional advantage is that in this manner, the insulating capacity of the package increases. Optionally, between the layers of cardboard, stiffening elements can be provided, in the shape of, for instance, U-profiles extending at right angles to the bottom panel. The corners between adjoining side walls can also be reinforced, for instance by means of tubular profiles with a triangular or rectangular cross section, extending at right angles to the bottom panel.

In a second advantageous embodiment, a package according to the invention is characterized by the features of claim 10.

By constructing the outer package in two parts, an outer box and an insert part, the inner package can be sealed to the outer package in an even simpler manner, and the outer package, in particular the upper edge, can be designed to be less rigid. This is achieved in that the inner package can be sealed on the upper edge of the insert part, while this is still in a blank-shape. In this condition, the upper edge can be simply supported on a flat base. After the seal has been applied, the insert part is set up by folding the legs inward, whereupon, together with the inner package, it is slid into the outer box.

In a particularly advantageous embodiment, a package according to the invention is characterized by the features of claim 13.

By subdividing the inner and the outer package by means of one or more intermediate panels into smaller compartments which can each be opened individually, various individual products can be accommodated in one outer package without them affecting one another. These can for instance be assorted products, such as an assortment of different kinds of fish, or products which have to be stored at the same temperature, or products destined for the same customer. It is even possible to create a favorable environment for the respective product within each individual compartment, for instance by filling this compartment under a certain gas pressure or with a specific gas mixture. The package is also suitable for packaging one product in smaller, separate portions, which can be accessed independently of each other.

The invention further relates to a method for realizing a package.

With such a method, in a relatively simple and efficient manner transport packages can be manufactured which, due to the absence of projecting film edges, can be positioned closely together and can be stably stacked onto each other. As the packages can be handled as separate units, this manner of packaging furthermore offers freedom in relation to the order in which the packages are filled and closed off. This is particularly favorable in case the filling times vary strongly per package. The packages can be simply designed to be gas and odor-tight or, conversely, partially gas-permeable.

During transport, in particular air transport, packages can be exposed to reduced pressure in the environment. This can be taken into account in advance by providing a slightly reduced pressure in the inner package, for instance corresponding approximately to the expected minimum or average ambient pressure. This prevents the inner package, when exposed to a lower ambient pressure, from expanding more than is allowable and, as a result, tearing open.

The invention also relates to an apparatus for sealing together two layers of film material.

At the location of irregularities in the sealing base, the layers of film material to be sealed together form, due to their own rigidity and due to the stretching effect of the pressure means, a bridge with a more gradual configuration than the underlying irregularities. Due to the pressure means being flexible, they can follow the transitions, somewhat smoothened out by the film material, well. Surprisingly, it has appeared that, as a result, the pressure means can exert a contact pressure onto the heating element and the film layers which is sufficient to seal the film material together at the location of the irregularities in a gas-tight manner. There is no need for an increase in pressure, as with the known apparatuses. As a result, an apparatus according to the invention is suitable for realizing a gas-tight seal on a relatively irregular base with a relatively low pressure, while these irregularities can have at least the thickness of the blank.

A flexible heating element in the form of, for instance, a welding wire, can bend along with possible irregularities in the sealing base. Thus, peak voltages in the heating element are avoided or at least reduced, so that the heating element has less chance of becoming damaged.

In the further subclaims, further advantageous embodiments of a package, a method for its realization and an apparatus for applying a gas-tight seal are described.

In clarification of the invention, an exemplary embodiment of a transport package according to the invention will be described, as well as a method and apparatus for its manufacture, with reference to the drawing. In the drawing.

Figure 6:
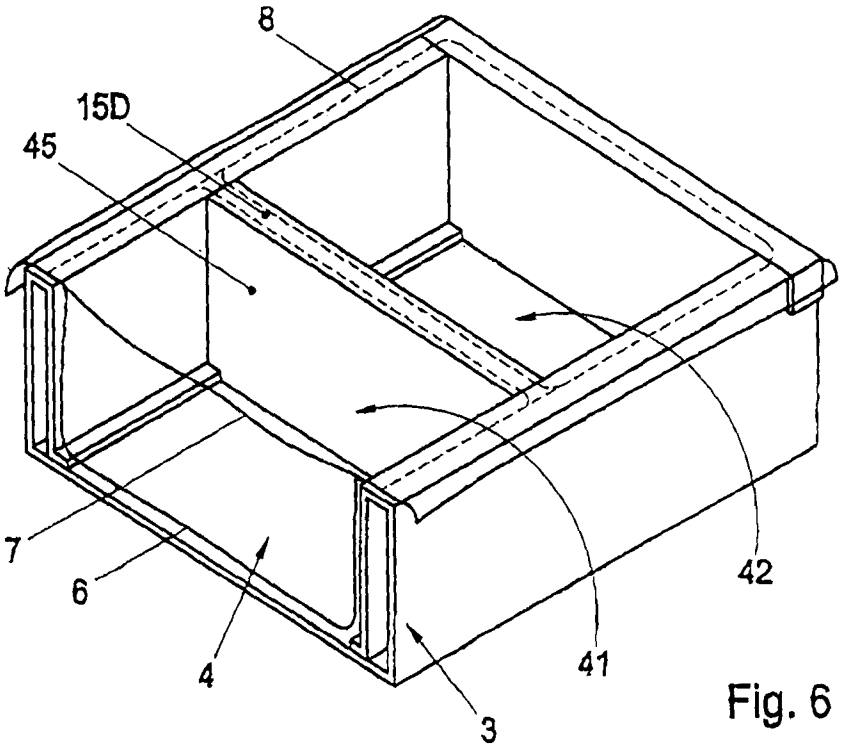
Figure 4:
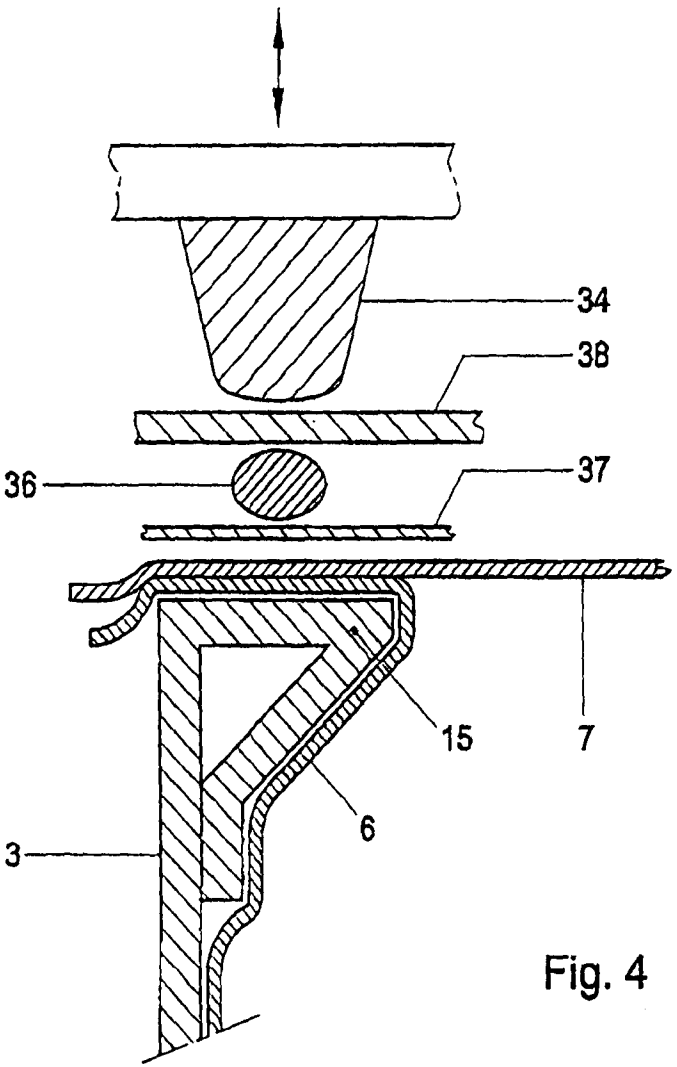

FIG. 4 schematically shows a cross section in front view of a sealing apparatus for sealing up an inner package;

FIG. 5 shows a perspective view of a second embodiment of a package according to the invention, in which the outer package consists of two parts; and FIG. 6 shows a perspective view of a third embodiment of a package according to the invention, in which the outer and inner package are subdivided in compartments.

Figure 1:
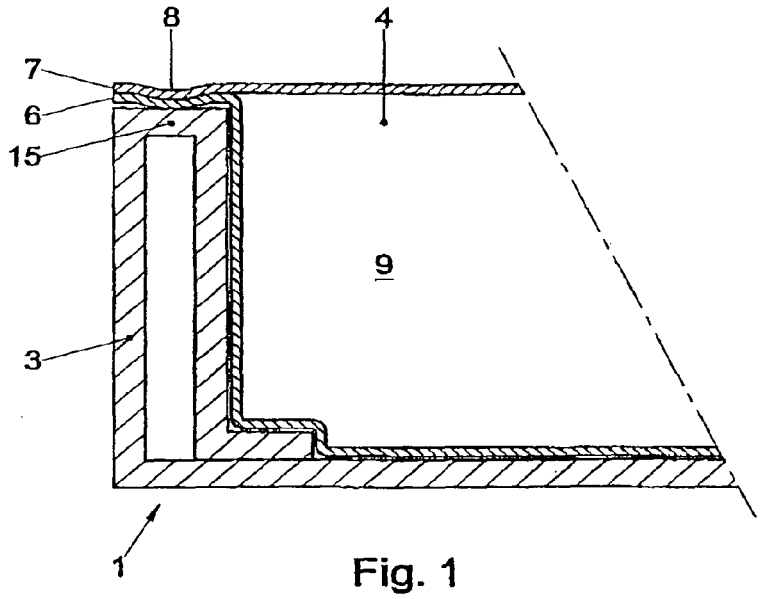
FIG. 1 shows a cross section of a package according to the invention.

FIG. 1 shows a package 1 according to the invention comprising a relatively rigid, box-shaped outer package 3 and an inner package 4 formed from film material, extending substantially within the outer package 3. The inner package 4 comprises a first and a second layer of film material 6, 7, between which a gas-tight space 9 is formed by thermally welding (in the following indicated with the term 'sealing') the layers 6, 7 onto each other along their circumference 8. In this space 9, goods can be sealed off from the environment gas-tightly and odor-tightly. As a result, such an inner package 4 is suitable, inter alia, for packaging either products having a strong odor themselves, for instance meat or fish, or products being susceptible to the odor of other products, such as fruit and vegetables. Due to the gas-tight closure, these different types of goods can be stored and/or transported in mutual proximity, without them influencing each other's odor or taste. Moreover, within such a gas-tight package 1 an atmosphere can be realized which is favorable to the product, so that, for instance, the product remains fresh or can be stored longer. Additionally, the second, covering film layer 7 can be manufactured from a material, in particular a plastic, which is gas-permeable in at least one direction. Such materials are known from practice. When the film layer is permeable in one direction, gases which may be produced within the package such as $CO_2$, can be discharged to the environment, so that a concentration prevailing within the package does not become undesirably high, while, conversely, gases from the environment cannot penetrate into the inner package. Also, however, a film can be used which is permeable in two directions, for instance via micro-perforations provided in the film. In that case, an actual exchange of gases between the inner package and the surroundings can take place. The extent to which this can happen naturally depends on, for instance, the surface and, possibly, the shape of the perforations, at least the total permeable surface or the permeability of the film to the respective gases. Further, the inner package can be provided with valve means, with which for instance a particular pressure can be maintained in the inner package, or with which, conversely, the pressure prevailing in the inner package and the ambient pressure can be equalized. Also, via such valve means, for instance moisture can be discharged from the inner package.

The outer package 3 protects the inner package 4 against external forces and provides the necessary rigidity and strength for, inter alia, moving, supporting and stacking the inner package 4 filled with goods. Additionally, the outer package 3 offers resistance to expansion forces of the inner package 4, which forces may occur as a result of a lower ambient pressure, for instance during air transport. With a package according to the invention, depending on the chosen materials and construction, high stacking strengths can be obtained in a simple manner, for instance, more than 500 kg can be supported on such a box. Even stacking strengths of 750 kg or 1000 kg are quite feasible.

Figure 2:
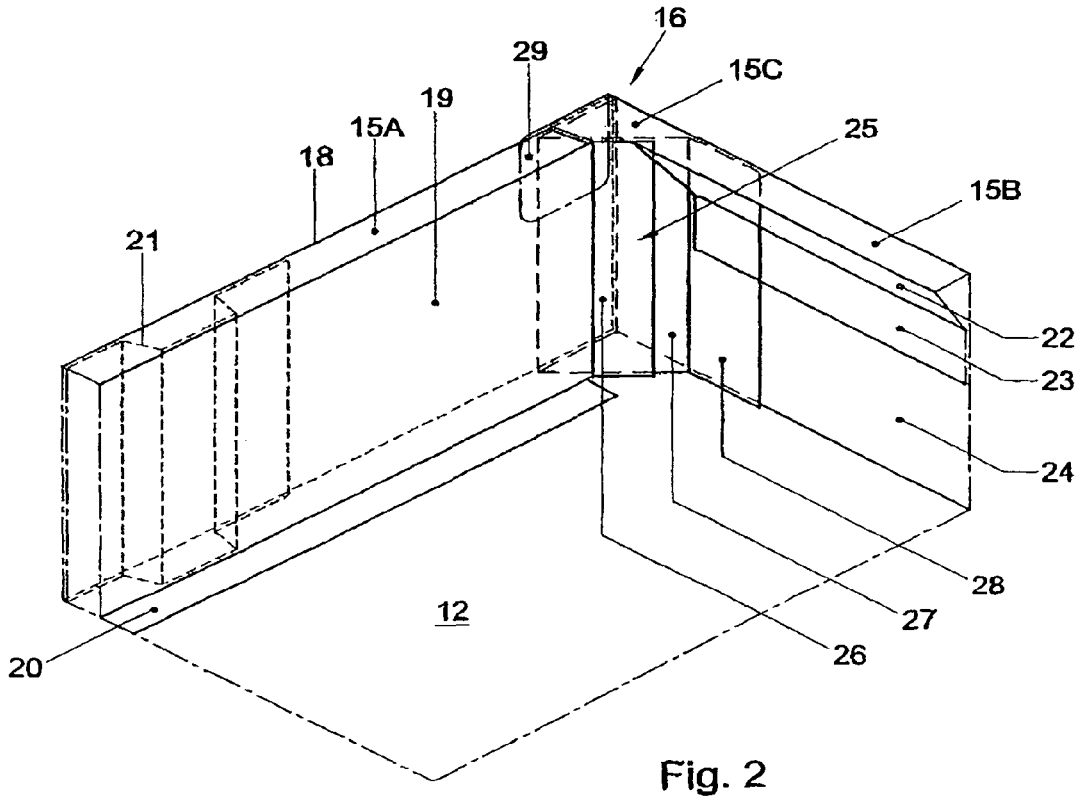
FIG. 2 shows a perspective view of a corner of an outer package according to the invention.
Figure 3:
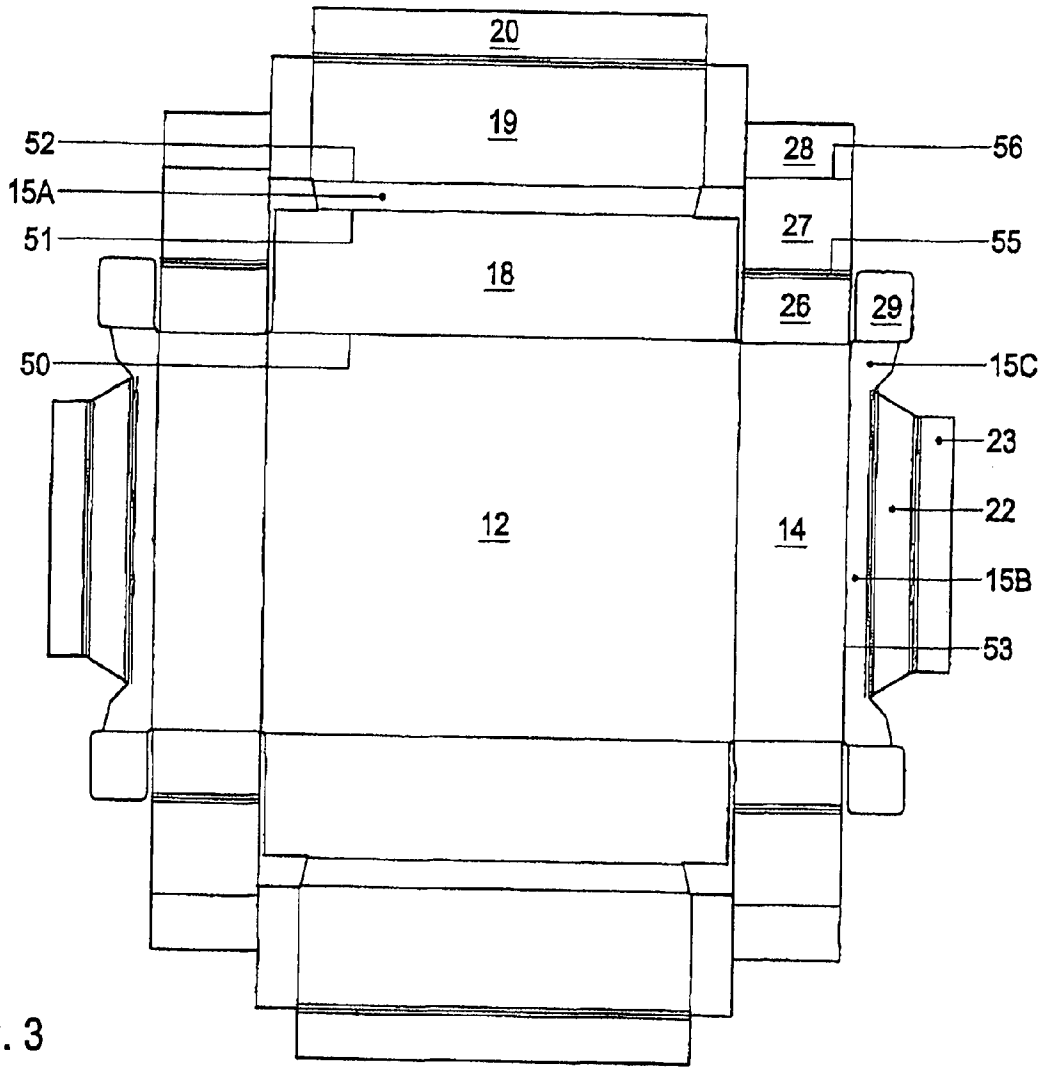
FIG. 3 shows a blank for an outer package of FIG. 2.

In FIG. 2, a possible outer package 3 is shown, at least one corner part thereof. This outer package 3 is made of cardboard and can be folded from a blank 10 as shown in FIG. 3. In this blank 10, parts corresponding to the outer package 3 of FIG. 2 are indicated with the same reference numerals. The outer package 3 comprises a rectangular bottom panel 12, provided along the large and small sides with a first and a second pair of pair-wise parallel upstanding sidewalls 13, 14. These sidewalls 13, 14 are provided, on the side remote from the bottom panel 12, with an upper edge 15, which extends substantially parallel to the bottom panel 12. This upper edge 15 serves, on the one hand, for stacking packages onto each other during transport and, on the other hand, as a base on which the inner package 4 can be sealed in a manner to be further described. To increase the rigidity and strength of this cardboard outer package 3, in particular the upper edge 15, the first sidewalls 13 on the large sides of the bottom panel 12 are made of double-walled design. To that end, in succession, an outer side panel 18 connected to the bottom panel 12, an upper edge part 15A and an inner side panel 19 are folded-in over 90° along respective folding lines 50, 51, 52, as shown in FIG. 2, whereupon the inner side panel 19 has been secured to the bottom panel 12 by means of a first fastening strip 20 connected thereto. The rigidity of the first side wall 13 has been further increased by means of loose stiffening elements 21 arranged between the inner and outer side panel 18, 19, extending at right angles to the bottom panel 12 and having a U-shaped profile in the example shown. The upper edge part 15B at the end side of the outer package 3 has also been reinforced. This has been achieved with the aid of a support panel 22 adjoining this upper edge 15B, and which is folded-in along folding line 53 over more than 90 degrees from this upper edge 15B and is fixed to the inner side of the second side wall 14 with a second fastening strip 23, as shown in FIG. 2.

Further, the corners 16 included by the first and second side walls 13, 14, are reinforced with the aid of a first and second corner reinforcement panel 26, 27 connected to the second side wall 14, and a third fastening strip 28. The panels 26, 27 and the strip 28 are folded along the respective folding lines 54, 55, 56 into a vertically extending, triangular tubular profile 25, as shown in FIG. 2, the first corner reinforcement panel 26 abutting against the inner side panel 19 and the third fastening strip 28 being fixed to the inner side of the second side wall 14. At the upper side, the triangular tubular profile 25 is closed off by a triangular extension 15C of the upper edge part 15B, which extension 15C is fastened to the outer side panel 18 with the aid of a fastening strip 29 connected therewith. The extension 15C and the upper edge part 15 adjoin each other preferably seamlessly and substantially with no difference in height, so that a flat, continuous upper edge 15 is obtained, the importance of which will be clarified hereinbelow. For an extensive description of a comparable corner reinforcement, reference is made to patent application EP 0 967 152 which belongs to applicant and which application is understood to be incorporated herein by reference.

The above-described box is only one possible embodiment of an outer package 3. Many different embodiments are possible within the field of application of the invention. For instance, in applicant's European patent application 0 731 032, a package is described which, because of its solid construction and flat upper edge is also suitable as an outer package 3 for the present invention. This application is also deemed to be incorporated herein by reference. Further, instead of from cardboard, the outer package can also be manufactured, for instance, from wood, plastic or polystyrene foam. Also, the package 3, in particular the bottom panel 12, can have a different shape than the rectangular one shown, for instance round or polygonal.

A package 1 according to the invention is realized as follows. An outer package 3 as described hereinabove is lined along the inner side and the upper edge 15 with a layer of thermoplastic, film-shaped material 6. To minimize creasing of the film-shaped material 6, in particular at the location of the upper edge 15, this film material 6 is pulled tight to some extent during application. The film material 6 can be placed loosely in the outer package 3, but is preferably attached to it, for instance by gluing or melting it thereto. Thereupon, the thus lined outer package 3 is filled with the goods to be transported and possible additions such as ice or gas in a desired composition for enhancing the preservability. Then, the goods are sealed off in a gas-tight manner by stretching a second layer of thermoplastic film material 7 over the upper edge 15 of the outer package 3 and sealing it to the first layer of film material 6 with a sealing apparatus 32 as schematically shown in FIG. 4, which will be described further hereinafter. After the two film layers 6, 7 have been attached to one another, any film material reaching beyond the upper edge 15 is cut off, whereupon the package 1 is ready for transport and can be carried off. The thus obtained package has no projecting or curling edges of film and, for that reason, can be stacked next to and onto other packages without problems so as to form a stable configuration. To increase the manageability, grips can be provided on, preferably in the sidewalls of the outer package. Furthermore, the package is relatively light and yet very robust and, moreover, after use, easy to separate into two parts, an inner and an outer package, which, each separately, are properly recyclable. Another advantage of this manner of packaging is that the packages can be individually manipulated. As a result, the outer packages lined with a first film layer can be fed to different filling lines, which filling lines will have different run-through times, depending on, inter alia, the size of the package to be filled, the degree of filling and the type of product being packaged. Following the filling lines, the packages are fed to a central sealing unit, where the second film layer is sealed onto the first film layer to close the inner package. As the packages can be individually manipulated, one is not bound to a regular filling or sealing order and the various filling times of the packages will therefore not cause unnecessary delay.

FIG. 4 schematically shows a cross section of a sealing apparatus 32, suitable for applying a gas-tight seal 8 between two layers of thermoplastic film material 6, 7 on an upper edge 15 of an outer package 3. To that end, the sealing apparatus 32 comprises a heating element 36 which, with the aid of pressure means 34, is pressed onto the layers of film material 6, 7, such that, under the influence of heat and pressure, the two film layers 6, 7 melt together thereby forming a gas-tight connection. For this connection to actually be gas-tight, the layers 6, 7 in the known sealing apparatuses are pressed together with great force during sealing on an anvil suitable for that purpose which is disposed next to the package and is provided with a very smooth supporting surface. Any irregularities in the films 6, 7 to be attached onto each other are equalized under influence of great pressure. The present invention is distinguished from the known apparatus in that the sealing base used, the upper edge 15, is less strong than the anvils normally used and therefore does not allow high operating pressures. Moreover, certainly when compared to the anvil mentioned, the upper edge can have an irregular surface. Surprisingly, nevertheless, a gas-tight seal can be realized on the upper edge. The sealing apparatus 32 according to the invention successfully does so by using flexible pressure means 34, for instance in the shape of a press-on profile manufactured from rubber. Additionally, the inherent stiffness of the film material leads to the film material not accurately following a transition in the sealing base but bridging it in a more or less smooth line. The flexible pressure means can follow these transitions, somewhat smoothened by the film material, well. As a result, at the location of the irregularities, the force of contact between the heating element 36 and film 7 can be kept approximately constant and a gas-tight seal can be realized without the excessive pressure increase with which the known sealing apparatuses eliminate the irregularities. The necessary pressure is approximately between 0.5 and 2.5 N/mm, more in particular between 1.0 and 1.5, depending on the materials used.

The heating element 36 too is preferably somewhat flexible, for instance in the form of a welding wire, so that it can bend along with irregularities in the upper edge 15. As a result, peak voltages in and accompanying damage to the heating element 36 are avoided. To prevent the heating element 36 from sticking to the second film layer 7 or the pressure means 34, further, between the parts mentioned a first and a second intermediate layer 37, 38, respectively, of for instance Teflon, is provided. The first intermediate layer 37 is preferably as thin as possible, so that no heat or only a minimum of heat is wasted through this. The second intermediate layer 38, by contrast, is preferably thicker, so that it protects the pressure means 34 against heat generated by the heating element 36. Instead of two separate intermediate layers 37, 38, the heating element 36 itself can naturally be covered on all sides with an antistick layer.

If the outer package 3 is manufactured from a heat sensitive material, for instance a thermoplastic plastic or polystyrene foam, the upper edge 15, before applying the inner package 4, can be covered with a heat resistant layer, for instance an edge of cardboard which is glued onto the upper edge. Thus, it is prevented that during the fastening and sealing of the two film layers 6, 7, the upper edge 15 becomes damaged under the influence of the heat supplied. The same result can be achieved by temporarily covering the upper edge, during the application of the seal, with a heat-insulating layer, which can be removed after completion of the seal. Also, the first film layer 6 can be built up from several layers, while the layer proximal to the upper edge is heat insulating.

Figure 5B:
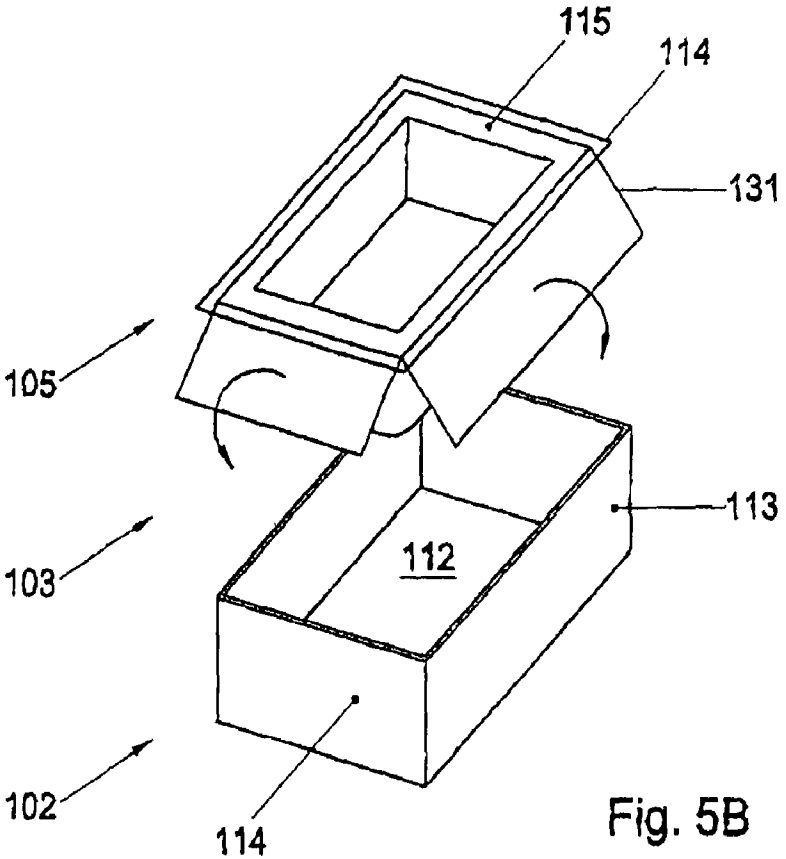
Figure 5A:
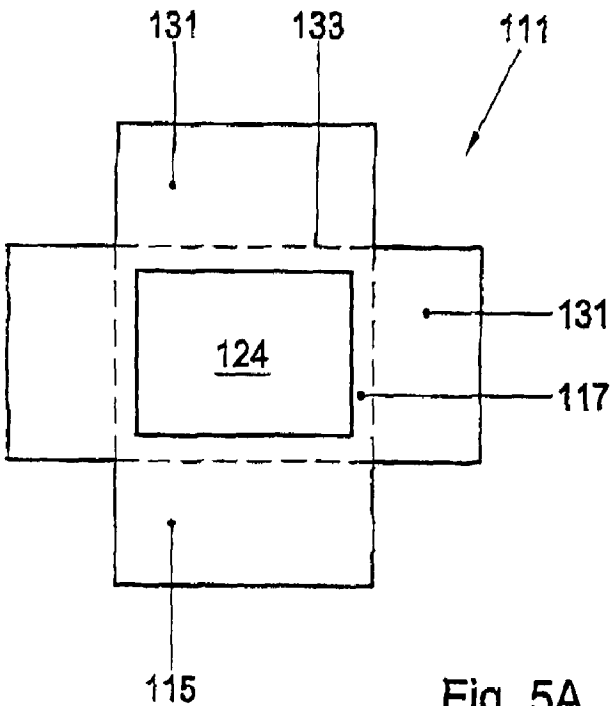

FIG. 5 shows a second embodiment of a transport package 101, the outer package 103 consisting of two parts, i.e. a substantially box-shaped outer box 102 and an insert part 105. The outer box 102 comprises a bottom panel 112, which is surrounded by upstanding sidewalls 113, 114. The outer box 102 can be reinforced in the manner described hereinabove by means of sidewalls designed as double walls, stiffening elements and/or corner reinforcement profiles, which, for the sake of clarity, have been omitted from FIG. 5. The basis for the insert part 105 is a blank 111, as shown in FIG. 5*a*. The blank 111 comprises a central face 117, substantially corresponding in shape to the bottom panel 112 of the outer box 102. The central face 117 is provided with an opening 124, surrounded by an upper edge 115. Furthermore, four legs 131 are pivotally connected to the central face 117 along four folding lines 133. Prior to the blank 111 being set up to form the insert part 105, the inner package 104 is sealed on the upper edge 115 of the blank, while at least this upper edge 115 of the blank is supported on a flat base. Optionally, a recess can be provided in this base for receiving and supporting the inner package 104. After applying, filling and sealing the inner package 104 in a manner already described hereinabove, the blank 111 is set up to form the insert part 105, while the legs 131 are folded along folding lines 133 in the direction of the central face 117 over an angle of 90°. Next, the insert part 105 together with the inner package 104 are slid into the outer box 102, as shown in FIG. 5*b*, the legs 131 at least partly supporting the central face 117 and the inner package 104. As the upper edge 115 can be supported during the sealing of the inner package 104, the upper edge 115 does not need to be very rigid in itself and the outer package as a whole can be made of relatively simple design.

FIG. 6 shows a third embodiment of a transport package 1 according to the invention, the outer package 3 being subdivided into two compartments 41, 42 by means of a vertical intermediate panel 45. This intermediate panel 45 extends from the bottom panel 12 to the upper side of the package and is provided at the upper edge 15 with a flat intermediate edge 15D, which adjoins, preferably seamlessly, at least without difference in height, the upper edge 15 mentioned. The outer package 3 is lined in the same manner as described hereinabove with a first layer of film material 6, which is attached to the upper edge 15 and preferably also to the intermediate edge 15C. Subsequently, the two compartments 41, 42 are each filled with a product to be transported and covered with a second layer of film material 7. The latter is sealed around each compartment, which is indicated in FIG. 5 with interrupted lines, so that two inner package parts are created with can be opened each individually. Instead of two separate seals at the location of the intermediate edge 15C, also one shared seal can suffice. Further, it is possible to design the intermediate panel 45 to be double-walled and to provide the intermediate edge 15C with a partition line (not shown) along which the outer package 3 can be divided into two separate, closed-off subpackages. The transport package 1 shown in FIG. 5 is suitable, inter alia, for assorted products, for instance various sorts of fish, but which cannot be packaged in the same space because, in that case, they could influence each other's taste. Additionally, such a subdivided package offers the advantage that, as the compartments can be individually opened, the consumer can take the products from the protective package in relatively small portions which are better suited to need. It is self-evident that the number of compartments can be increased as desired by providing the outer package with several intermediate panels.

The invention is not in any way limited to the exemplary embodiments described in the description and shown in the drawings. Many variations thereon are possible within the framework of the invention as outlined by the claims.

Thus, the two layers of film material may be sealed together on the sidewalls of the outer package, either on the inside or on the outside. To that end, the sidewalls offer sufficient space and can, moreover, be simply locally reinforced to resist the pressures occurring during sealing. Also, a combination is possible in which the film material is attached onto two upper edge parts located opposite each other and onto two side walls located opposite each other, which side walls extend between the two upper edge parts mentioned. In this manner, the formation of creases of the film material near the corners of the outer package can be avoided. Moreover, in this case, the outer package only needs to be provided with a flat upper edge on two opposite sides. Further, the film layers can be sealed on the still unfolded blank of the outer package, whereupon the blank is folded around the inner package to form an enveloping outer package. This reversal of sequence offers the advantage that the upper edge can be less rigid. The fact is that during the occurrence of the greatest forces, i.e. during the sealing together of the layers of film material, the upper edge in the blank can be simply supported on a flat base. Once in folded condition, the upper edge merely has to have sufficient stacking strength, which will mostly be lesser than the strength necessary for withstanding the sealing forces mentioned. Another possibility whereby a less rigid upper edge can suffice is to temporarily support the upper edge during sealing of the film layers with the aid of a supporting element serving as an anvil. To that end, for instance, the sidewalls of the package can be designed to be hollow, so that the supporting element can be slid in from an open underside. The outer package can further be provided with a water-repellant layer. The outer package may be equipped with a cover for protecting the second film layer. Instead of being manufactured from a flexible material, the pressure means in the sealing apparatus can be flexibly supported by means of a spring and/or damper. Naturally, a combination of the two is also possible.

These and many variations are understood to fall within the scope of the invention as outlined by the claims.

The invention claimed is:

1. A package that can be stacked in a stable manner and that can be positioned directly next to another such package, the package comprising:

an inner package formed from at least two layers of film material, the two layers of film material being connected to each other in a gas-tight manner near their perimeter by means of an inherently closed sealing edge; and an outer package formed from a relatively rigid material, the outer package having a reinforced wall part that provides a sealing base about the entire outer package for the formation of the sealing edge against an outer surface of the sealing base, wherein the two layers of film material are thermally welded onto each other against the outer surface of the the sealing base of the wall part of the outer package, substantially without extending laterally beyond the outer surface of the package, as defined by side walls, bottom walls and upper walls of said package.

2. A package according to claim 1, wherein the outer package comprises a bottom panel provided on all sides with upstanding side walls, which side walls are provided on the side remote from the bottom panel with a substantially flat upper edge, a first layer of film material extending from the upper edge along the inner &de of the outer package, and a second layer of film material being sealed on the first layer at the location of the upper edge for closure of the inner package.

3. A package according to claim 2, wherein an upper edge of the wall part is substantially parallel to the bottom panel.

4. A package according to claim 1, wherein the inner package is manufactured from plastic, in particular a thermoplastic plastic.

5. A package according to claim 2, wherein the inner package, that is to say at least the second layer of film material is gas-permeable in at least one direction.

6. A package according to claim 1, wherein at least the wall part of the outer package serving as the base for forming the sealing edge is manufactured from a heat-resistant material, in particular cardboard.

7. A package according to claim 1, wherein the outer package is manufactured from cardboard, preferably solid cardboard.

8. A package according to claim 1, wherein the outer package is folded from a blank.

9. A package according to claim 2, wherein the outer package near the side walls comprises stiffening elements, which extend from the bottom panel as far as the upper edge, for supporting this upper edge.

10. A package according to claim 1, wherein the outer package is built up from at least an exterior package and an insert part, the insert part being set-up from a substantially flat blank provided with a middle face and a number of legs pivotally connected to the central face, wherein, in the middle face an opening is provided, surrounded by an upper edge for receiving the inner package, wherein, in set-up condition, the insert part is fittingly received in the exterior package and the middle face with the inner package is carried at least partly in the exterior package by the legs and wherein the sealing edge is formed on the upper edge.

11. A package according to claim 1, wherein the outer package can be stacked onto an upper edge of the wall part of a second outer package and wherein the occurring stacking forces are substantially absorbed by the outer package.

12. A package according to claim 1 wherein the outer package has a stacking strength of at least 5000 N, preferably approximately 7500 N.

13. A package according to claim 1, wherein the outer package by means of at least one cross panel is divided in compartments, wherein the at least one cross panel is provided, on the side remote from the bottom panel with a substantially flat edge, onto which edge the second layer of film material can be sealed onto the first layer of film material, the arrangement being such that inner package parts in the compartments can be opened separately.

14. A package according to claim 2, wherein:

the upper edge is substantially parallel to the bottom panel;

the inner package is manufactured from plastic, in particular a thermoplastic plastic;

the inner package, that is to say at least the second layer of film material is gas-permeable in at least one direction;

at least the wall part of the outer package serving as the base for forming the sealing edge is manufactured from a heat-resistant material, in particular cardboard;

the outer package is manufactured from cardboard, preferably solid cardboard;

the outer package is folded from a blank; and the outer package near the side walls comprises stiffening elements, which extend from the bottom panel as far as the upper edge, for supporting this upper edge.

15. A package according to claim 1, wherein:

the outer package is built up from at least an exterior package and an insert part, the insert part being set-up from a substantially flat blank provided with a middle face and a number of legs pivotally connected to the central face, wherein, in the middle face an opening is provided, surrounded by an upper edge for receiving the inner package, wherein, in set-up condition, the insert part is fittingly received in the exterior package and the middle face with the inner package is carried at least partly in the exterior package by the legs and wherein the sealing edge is formed on the upper edge;

the outer package can be stacked onto the upper edge of a second outer package and wherein the occurring stacking forces are substantially absorbed by the outer package;

the outer package has a stacking strength of at least 5000 N, preferably approximately 7500 N; and the outer package by means of at least one cross panel is divided in compartments, wherein the at least one cross panel is provided, on the side remote from the bottom panel with a substantially flat edge, onto which edge the second layer of film material can be sealed onto the first layer of film material, the arrangement being such that inner package parts in the compartments can be opened separately.

16. A package according to claim 14, wherein:

the outer package is built up from at least an exterior package and an insert part, the insert part being set-up from a substantially flat blank provided with a middle face and a number of legs pivotally connected to the central face, wherein, in the middle face an opening is provided, surrounded by an upper edge for receiving the inner package, wherein, in set-up condition, the insert part is fittingly received in the exterior package and the middle face with the inner package is carried at least partly in the exterior package by the legs and wherein the sealing edge is formed on the upper edge;

the outer package can be stacked onto the upper edge of a second outer package and wherein the occurring stacking forces are substantially absorbed by the outer package;

the outer package has a stacking strength of at least 5000 N, preferably approximately 7500 N; and the outer package by means of at least one cross panel is divided in compartments, wherein the at least one cross panel is provided, on the side remote from the bottom panel with a substantially flat edge, onto which edge the second layer of film material can be sealed onto the first layer of film material, the arrangement being such that inner package parts in the compartments can be opened separately.

* * * * *

UNITED STATES PATENT AND TRADEMARK OFFICE

CERTIFICATE OF CORRECTION

PATENT NO. : 7,331,481 B2
APPLICATION NO. : 10/363336
DATED : February 19, 2008
INVENTOR(S) : Peter Paul van Eijndhoven et al.

It is certified that error appears in the above-identified patent and that said Letters Patent is hereby corrected as shown below:

Column 9, line 67, “&de;” should read --side--.

Signed and Sealed this

Twenty-third Day of December, 2008

JON W. DUDAS
*Director of the United States Patent and Trademark Office*

UNITED STATES PATENT AND TRADEMARK OFFICE

CERTIFICATE OF CORRECTION

PATENT NO. : 7,331,481 B2
APPLICATION NO. : 10/363336
DATED : February 19, 2008
INVENTOR(S) : Peter Paul van Eijndhoven et al.

It is certified that error appears in the above-identified patent and that said Letters Patent is hereby corrected as shown below:

In the Claims

Column 9, line 58, “the sealing” should read -- sealing --.

Signed and Sealed this
Twenty-first Day of October, 2014

Michelle K. Lee

Michelle K. Lee
*Deputy Director of the United States Patent and Trademark Office*